US010847911B2

(12) United States Patent
Chi

(10) Patent No.: US 10,847,911 B2
(45) Date of Patent: Nov. 24, 2020

(54) ELECTRICAL CONNECTOR FOR FFC/FPC

(71) Applicant: BELLWETHER ELECTRONIC CORP., Taoyuan (TW)

(72) Inventor: Ung-Liang Chi, Taipei (TW)

(73) Assignee: BELLWETHER ELECTRONIC CORP., Taoyuan (TW)

( * ) Notice: Subject to any disclaimer, the term of this patent is extended or adjusted under 35 U.S.C. 154(b) by 0 days.

(21) Appl. No.: 16/698,962

(22) Filed: Nov. 28, 2019

(65) Prior Publication Data

US 2020/0185849 A1 Jun. 11, 2020

Related U.S. Application Data

(60) Provisional application No. 62/776,493, filed on Dec. 7, 2018.

(51) Int. Cl.

| | |
|---|---|
| ***H01R 12/79*** | (2011.01) |
| ***H01R 12/88*** | (2011.01) |
| *H01R 13/193* | (2006.01) |
| *H01R 12/89* | (2011.01) |
| *H01R 12/77* | (2011.01) |
| *H01R 13/639* | (2006.01) |

(Continued)

(52) U.S. Cl.

CPC ..... *H01R 12/79* (2013.01); *H01R 12/88* (2013.01); *H01R 4/5066* (2013.01); *H01R 12/592* (2013.01); *H01R 12/61* (2013.01); *H01R 12/613* (2013.01); *H01R 12/62* (2013.01); *H01R 12/721* (2013.01); *H01R 12/771* (2013.01); *H01R 12/774* (2013.01); *H01R 12/85* (2013.01); *H01R 12/89* (2013.01); *H01R 13/193* (2013.01); *H01R 13/5829* (2013.01); *H01R 13/62933* (2013.01); *H01R 13/62988* (2013.01); *H01R 13/639* (2013.01)

(58) Field of Classification Search

CPC ..... H01R 12/79; H01R 12/88; H01R 13/193; H01R 12/89; H01R 12/774; H01R 12/592; H01R 12/771; H01R 12/62; H01R 12/721; H01R 13/639; H01R 12/85; H01R 12/61; H01R 12/613; H01R 13/5829; H01R 13/62933; H01R 13/62988; H01R 4/5066

USPC ..... 439/260, 492, 495, 499

See application file for complete search history.

(56) References Cited

U.S. PATENT DOCUMENTS

2002/0115340 A1* 8/2002 Yamane ..... H01R 23/661 439/495

2008/0003858 A1* 1/2008 Little ..... H01R 12/62 439/260

2017/0373436 A1* 12/2017 Nagae ..... H01R 13/6272

* cited by examiner

*Primary Examiner* — Abdullah A Riyami
*Assistant Examiner* — Justin M Kratt
(74) *Attorney, Agent, or Firm* — Li & Cai Intellectual Property Office

(57) ABSTRACT

An electrical connector for receiving an FFC/FPC includes an insulating housing, a plurality of conductive terminals, a pair of retaining pins, and a metal cover. The insulating housing includes a main body and a pair of shoulder parts. Each shoulder part has a guiding bump, and a pre-pressing board. An oblique-entry space is formed between the guiding bump and the pre-pressing board. The pair of retaining pins are respectively fixed in the pair of shoulder parts. A bottom end of the retaining pin is exposed from the bottom surface of the insulating housing. The metal cover is slidably disposed on the top surface of the insulating housing, and includes a top pressing plate and a pair of side sliding rails. A front end of the top pressing plate has a pressing rib. The metal cover is movably arranged between an initial position and a pressed position.

10 Claims, 18 Drawing Sheets

(51) Int. Cl.

| | |
|---|---|
| *H01R 12/59* | (2011.01) |
| *H01R 12/72* | (2011.01) |
| *H01R 12/62* | (2011.01) |
| *H01R 13/629* | (2006.01) |
| *H01R 12/61* | (2011.01) |
| *H01R 12/85* | (2011.01) |
| *H01R 4/50* | (2006.01) |
| *H01R 13/58* | (2006.01) |

ELECTRICAL CONNECTOR FOR FFC/FPC

CROSS-REFERENCE TO RELATED PATENT APPLICATION

This application claims the benefit of priority to U.S. provisional Patent Application No. 62/776,493, filed on Dec. 7, 2018. The entire content of the above-identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electrical connector between a cable and a printed circuit board, and more particularly to an electrical connector for flexible flat cable (FFC)/flat printed circuit board (FPC) used to electrically connect an FFC/FPC to a printed circuit board.

BACKGROUND OF THE DISCLOSURE

In general, to stably receive an FPC board or FFC (referred to as an FPC/FFC connector), a conventional electrical connector includes a lifting type cover that works as an actuator, which is usually a cam and disposed with H-shaped terminals. The FFC/FPC is fixedly clamped by the terminals. In addition, some lifting type covers press against the terminals directly so that the terminals are able to fixedly clamp the FFC/FPC. This is to prevent the FFC/FPC from detaching from the electrical connector accidentally. This kind of connector is also referred to as a flip-lock type (rotatory cover) connector. The flip-lock type connector can be further classified as a forward-rotary type connector, in which the cover rotates towards the FFC/FPC, or a rearward-rotary type connector, in which the cover rotates rearwardly.

As sizes of electronic products in general have decreased, electrical connectors have also become smaller and thinner. However, smaller terminals or covers of the electrical connector are often less sturdy. This may result in reduced structural stress, an insufficient amount of pressure against the terminals by the covers, or an insufficient clamping force of the terminals. As a result, the terminals may not be able to fixedly clamp the FFC/FPC, and a poor connection between the terminals and the FFC/FPC may even result in an open-circuit.

Furthermore, the cover of the flip-lock type connector rotates towards the FFC/FPC to cover the FFC/FPC. Therefore, a lifting direction of the cover is the same as an upward pulling direction of the FFC/FPC. If an upward force component occurs during an assembling process of the FFC/FPC, the cover may be lifted and the FFC/FPC may be detached from the electrical connector.

SUMMARY OF THE DISCLOSURE

In response to the above-referenced technical inadequacies, the present disclosure provides an electrical connector for a flexible flat cable, which can increase a retaining force for an FFC/FPC, so as to prevent the FFC/FPC from accidentally detaching from the electrical connector.

In response to the above-referenced technical inadequacies, the present disclosure further provides a flexible flat cable connector, which can provide the FFC/FPC a function of anti-electromagnetic interference.

In one aspect, the present disclosure provides a flexible flat cable connector for receiving an FFC/FPC. Two sides of the FFC/FPC each have a fixing portion respectively. The electrical connector includes an insulating housing, a plurality of conductive terminals, a pair of retaining pins, and a metal cover. The insulating housing includes a main body and a pair of shoulder parts. The pair of shoulder parts are arranged at two sides of the main body. A plurality of terminal slots are formed in the main body. A guiding bump and a pre-pressing board are respectively formed on the pair of shoulder parts. An oblique-entry space is formed between the guiding bump and the pre-pressing board. The conductive terminals are respectively received in the terminal slots. The pair of retaining pins are respectively fixed in the pair of shoulder parts, and an end of each of the retaining pins are exposed from a bottom of the insulating housing. The metal cover is slidably disposed on a top surface of the insulating housing. The metal cover includes a top pressing plate and a pair of side sliding rails. The pair of side sliding rails are respectively connected to two sides of the top pressing plate. The pair of side sliding rails are slidably mounted on the pair of shoulder parts respectively, and a front end of the top pressing plate forms a pressing rib. The pressing rib is protruded toward the insulating housing. The metal cover is movable between an initial position and a pressed position. When the FFC/FPC is inserted in the electrical connector for FFC/FPC, the fixing portions of the FFC/FPC are received in the oblique-entry space, and the pre-pressing board is pressed against a top surface of the FFC/FPC. When the metal cover is moved to the pressed position, the metal cover contacts with the pair of retaining pins and the pressing rib of the metal cover presses the FFC/FPC to contact with the conductive terminals.

Therefore, the present disclosure has advantages as follows. The present disclosure provides the electrical connector for FFC/FPC having the metal cover which can be moved in a horizontal sliding manner Through the horizontal sliding metal cover, the cover directly presses and holds the FFC/FPC without other actuating mechanisms and related terminals, so that the terminals can be simplified and an overall height and size can be reduced. In addition, the guiding bump and the oblique-entry space of the insulating housing can reduce an occurrence of displacement of the FFC/FPC. Moreover, as a result of the cover that can be moved in a horizontal sliding manner directly pressing and holding the FFC/FPC, the FFC/FPC can be stably fixed and an occurrence of displacement of the FFC/FPC can be reduced. Furthermore, the metal cover covers the FFC/FPC and contacts the retaining pins, so as to form a complete circuitry loop with the printed circuit board, which can avoid an electromagnetic interference.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
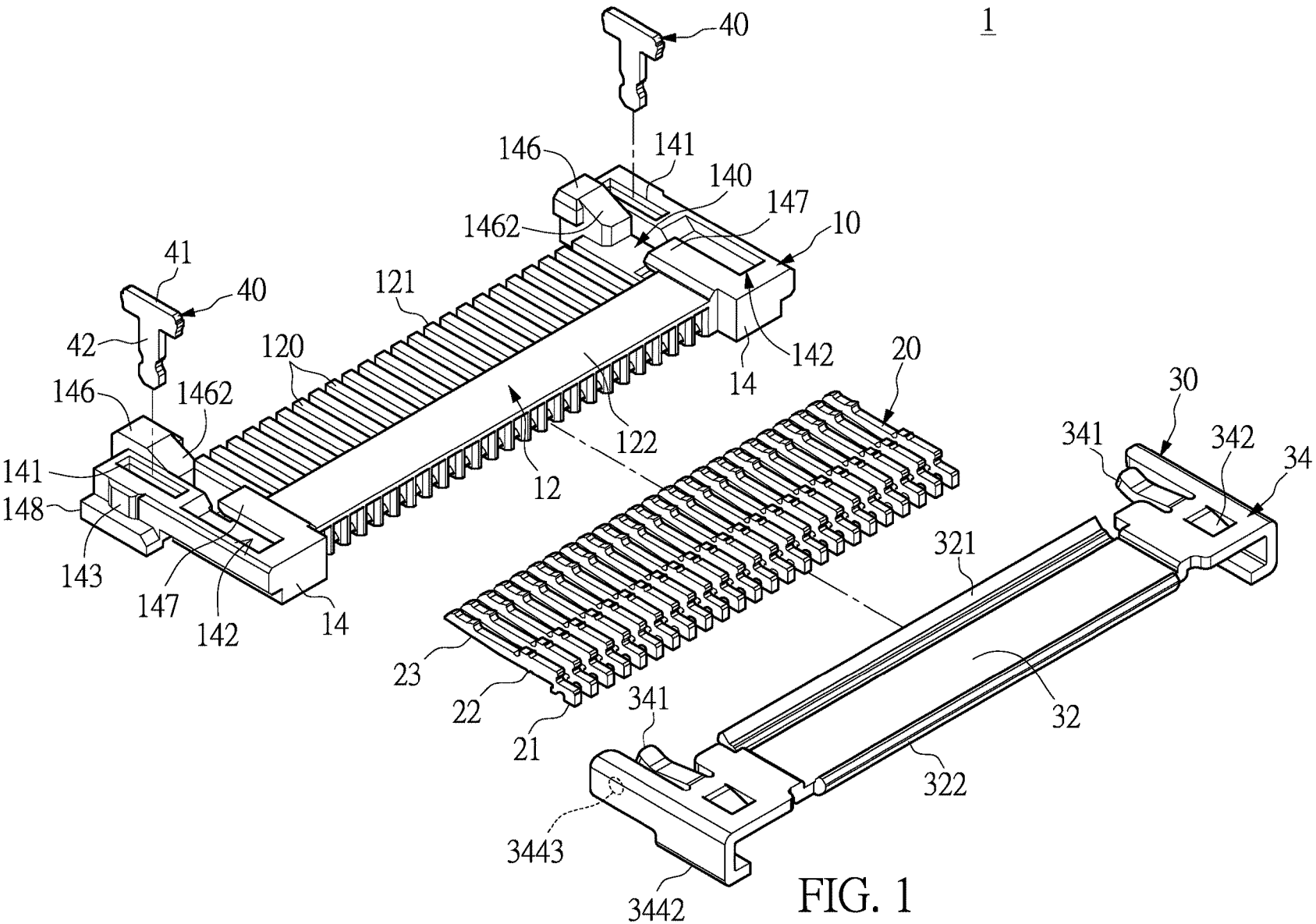
FIG. 1 is a perspective exploded view of an electrical connector for FFC/FPC of a first embodiment according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
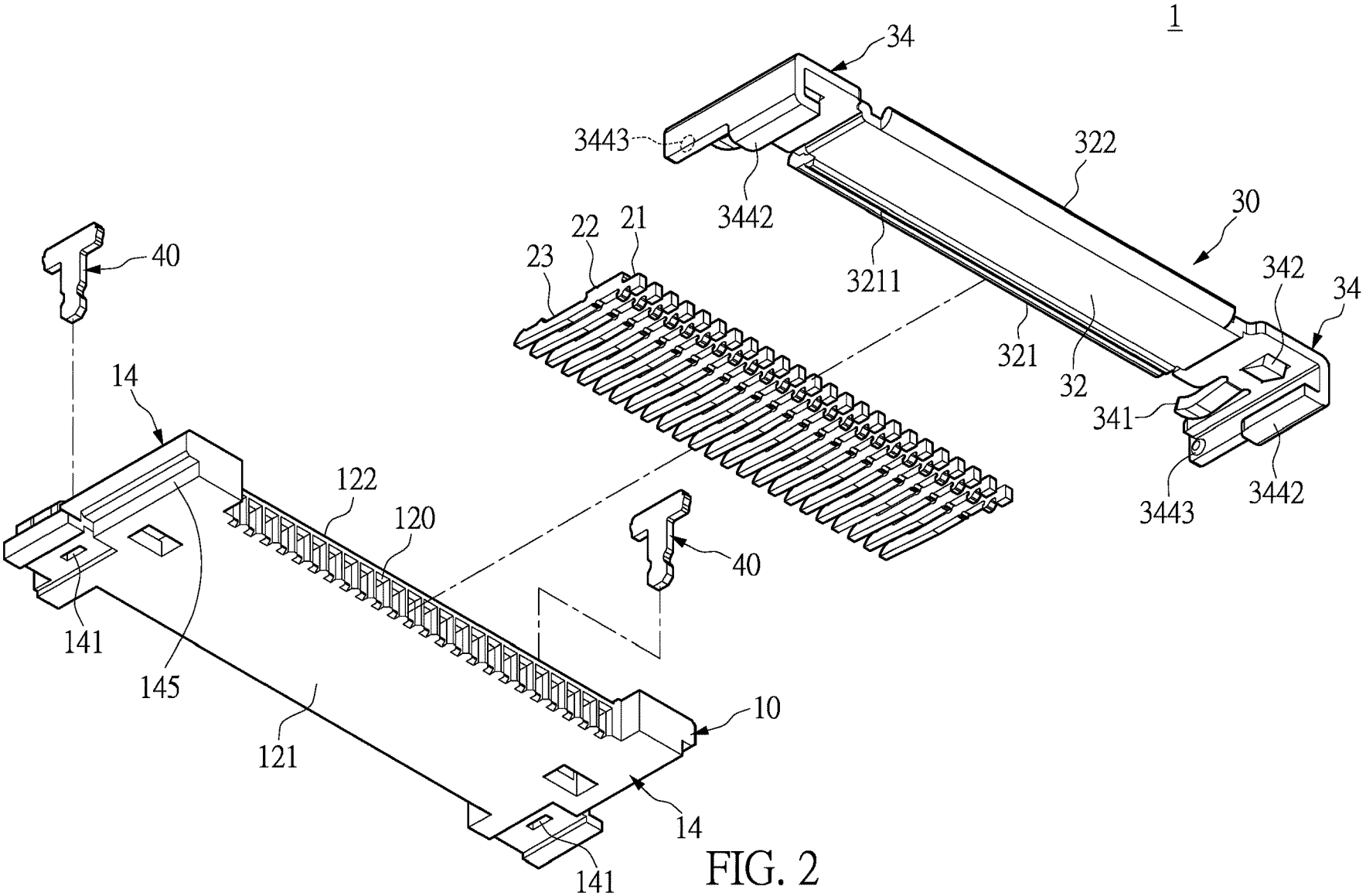
FIG. 2 is another perspective exploded view of the electrical connector for FFC/FPC of the first embodiment according to the present disclosure.

Reference is made to FIG. 1 to FIG. 2, which are perspective views of an electrical connector for an FFC/FPC according to the present disclosure. The present disclosure provides an electrical connector 1 for receiving a flexible flat cable or a flat printed circuit board (FFC/FPC) C (referring to FIG. 3). Two fixing portions C1 respectively form at two sides of the FFC/FPC C. The electrical connector 1 for an FFC/FPC includes an insulating housing 10, a plurality of conductive terminals 20, a metal cover 30, and a pair of retaining pins 40. For ease of illustration, in this embodiment, the electrical connector 1 has one end for receiving the FFC/FPC C which is defined as a front end, and another end far away the FFC/FPC C which is defined as a rear end.

The insulating housing 10 includes a main body 12 and a pair of shoulder parts 14. The pair of shoulder parts 14 are integrally connected to two sides of the main body 12, respectively. The main body 12 has a plurality of terminal slots 120 formed therein. The terminal slot 120 passes through the main body 12 along a longitudinal direction of the FFC/FPC C. The pair of shoulder parts 14 respectively has a guiding bump 146 and a pre-pressing board 147. The guiding bump 146 is formed adjacent to the main body 12. The guiding bump 146 and the pre-pressing board 147 are opposite to each other along the longitudinal direction of the FFC/FPC C. An oblique-entry space 140 is formed between the guiding bump 146 and the pre-pressing board 147. The oblique-entry space 140 has an upward opening facing towards the main body 12. The guiding bump 146 has a guiding ramp 1462, and the pre-pressing board 147 is formed facing towards the guiding ramp 1462.

The insulating housing 10 further includes two stop protrusions 143 which are respectively formed on two outer lateral sides of the pair of shoulder parts 14. The metal cover 30 further includes two positioning knobs 3443 which are respectively formed on a pair of side sliding rails 34. The positioning knob 3443 is formed facing towards the insulating housing 10, and is able to slide to a front area or a rear area of the stop protrusion 143 that respectively corresponds to a pressed position and an initial position of the metal cover 30.

In detail, the main body 12 of the insulating housing 10 can further be divided into a front portion 121 and a rear portion 122. The rear portion 122 is connected to a rear side of the front portion 121. A height of the rear portion 122 is higher than a height of the front portion 121, so as to form a height difference for receiving the FFC/FPC C.

Figure 9:
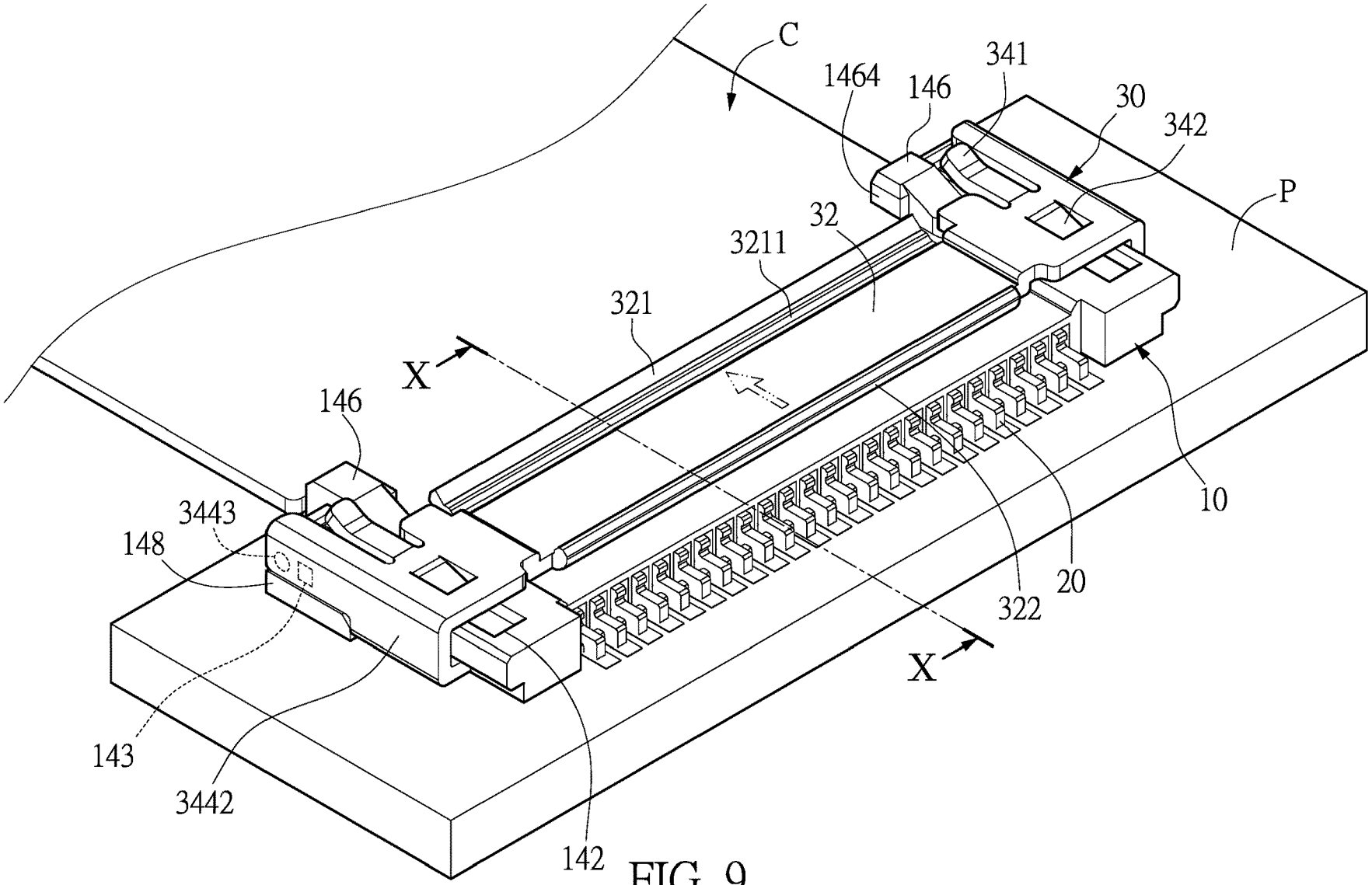
FIG. 9 is a perspective view of the electrical connector of the first embodiment with the metal cover which is moved to a pressed position according to the present disclosure.

The conductive terminals 20 are respectively received in the terminal slots 120. In this embodiment, each conductive terminal 20 includes a soldering portion 21, an interfering portion 22 and a contacting portion 23. The soldering portion 21 is exposed from a rear end of the insulating housing 10, and can be soldered to a printed circuit board P (as shown in FIG. 9). The interfering portion 22 is extended forward from the soldering portion 21, and fixed in the terminal slot 120. The contacting portion 23 is extended forward from the interfering portion 22, so as to be electrically connected to the FFC/FPC C. The terminal slots 120 pass through the top surface of the front portion 121, and the contacting portions 23 of the conductive terminals 20 are exposed from the top surface of the front portion 121.

In this embodiment, the pair of retaining pins 40 are respectively received in a pair of lateral-insertion slits 141. Each end of the retaining pins 40 is exposed from the bottom surface of the insulating housing 10. In detail, each retaining pin 40 of this embodiment includes a top portion 41 and a leg portion 42. The leg portion 42 extends downward from a middle portion to the bottom edge of the top portion 41, and is substantially T-shaped. The leg portion 42 is exposed from the bottom surface of the insulating housing 10, and soldered to the printed circuit board P. Therefore, the electrical connector 1 for FFC/FPC can be firmly fixed, and is able to electrically connect a ground circuit of the printed circuit board P. The top portion 41 of the retaining pin 40 is exposed from the top surface of the insulating housing 10, and is able to contact with the metal cover 30, so that the metal cover 30 can be grounded. In this embodiment, to fix the pair of retaining pins 40, each of the shoulder parts 14 of the insulating housing 10 has a lateral-insertion slit 141, and the lateral-insertion slit 141 is formed at an outer side of the guiding bump 146. The pair of retaining pins 40 is respectively received in the pair of lateral-insertion slits 141.

In this embodiment, the metal cover 30 can be slidably disposed on the top surface of the insulating housing 10. The metal cover 30 includes a top pressing plate 32 and the pair of side sliding rails 34. The pair of side sliding rails 34 are connected to two sides of the top pressing plate 32 respectively. The pair of side sliding rails 34 are slidably disposed on the pair of shoulder parts 14 of the insulating housing 10 respectively. A front end of the top pressing plate 32 forms a pressing rib 3211, and the pressing rib 3211 faces the insulating housing 10. In addition, the metal cover 30 further has a front guiding portion 321 which is formed obliquely and extends from a front edge of the top pressing plate 32 upwardly. The top pressing plate 32 has a holding portion 322 extended upwardly from a rear edge thereof. The front guiding portion 321 can guide the FFC/FPC C, and the holding portion 322 is for a user to push the metal cover 30 forward easily.

Figure 3:
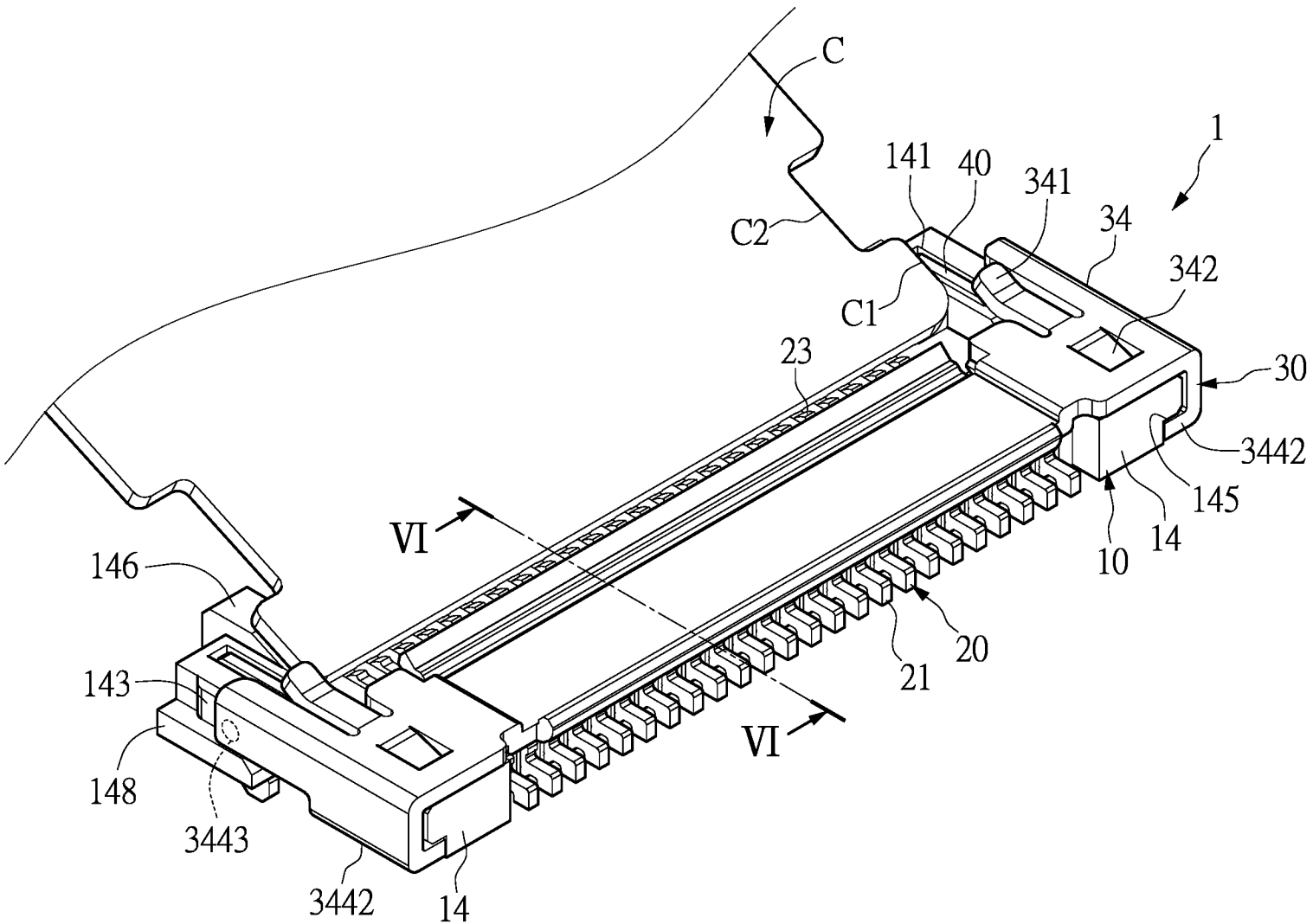
FIG. 3 is a perspective assembled view of the electrical connector for FFC/FPC of the first embodiment according to the present disclosure.

The metal cover 30 is movable between an initial position (as shown in FIG. 3) and a pressed position (as shown in FIG. 9). The metal cover 30 can be slid rearwardly to the initial position along the top surface of the main body 12 of the insulating housing 10. The initial position corresponds to the status of which the FFC/FPC C can be pushed in or pulled out, further details of which will be given below. The metal cover 30 can be slid forward to the pressed position along the top surface of the main body 12 of the insulating housing 10. The pressed position corresponds to the status of whether the FFC/FPC C is pressed and fixed in the electrical connector 1, further details of which will be given below. In this embodiment, the top surface of the main body 12 of the insulating housing 10 can be referred to as a horizontal surface. The metal cover 30 is slid along the horizontal surface to press and contact the FFC/FPC C (as shown in FIG. 9), or release the FFC/FPC C (as shown in FIG. 3). Such a horizontal moving manner is different from a conventional cover rotating along an axle, and such design can prevent the FFC/FPC from being detached from the electrical connector when the cover is lifted. In addition, the metal cover of horizontal moving type can cover the FFC/FPC, and the metal cover 30 contacts with the retaining pin 40 so as to form a complete circuit loop with the printed circuit board for avoiding an electromagnetic interference.

Figure 4:
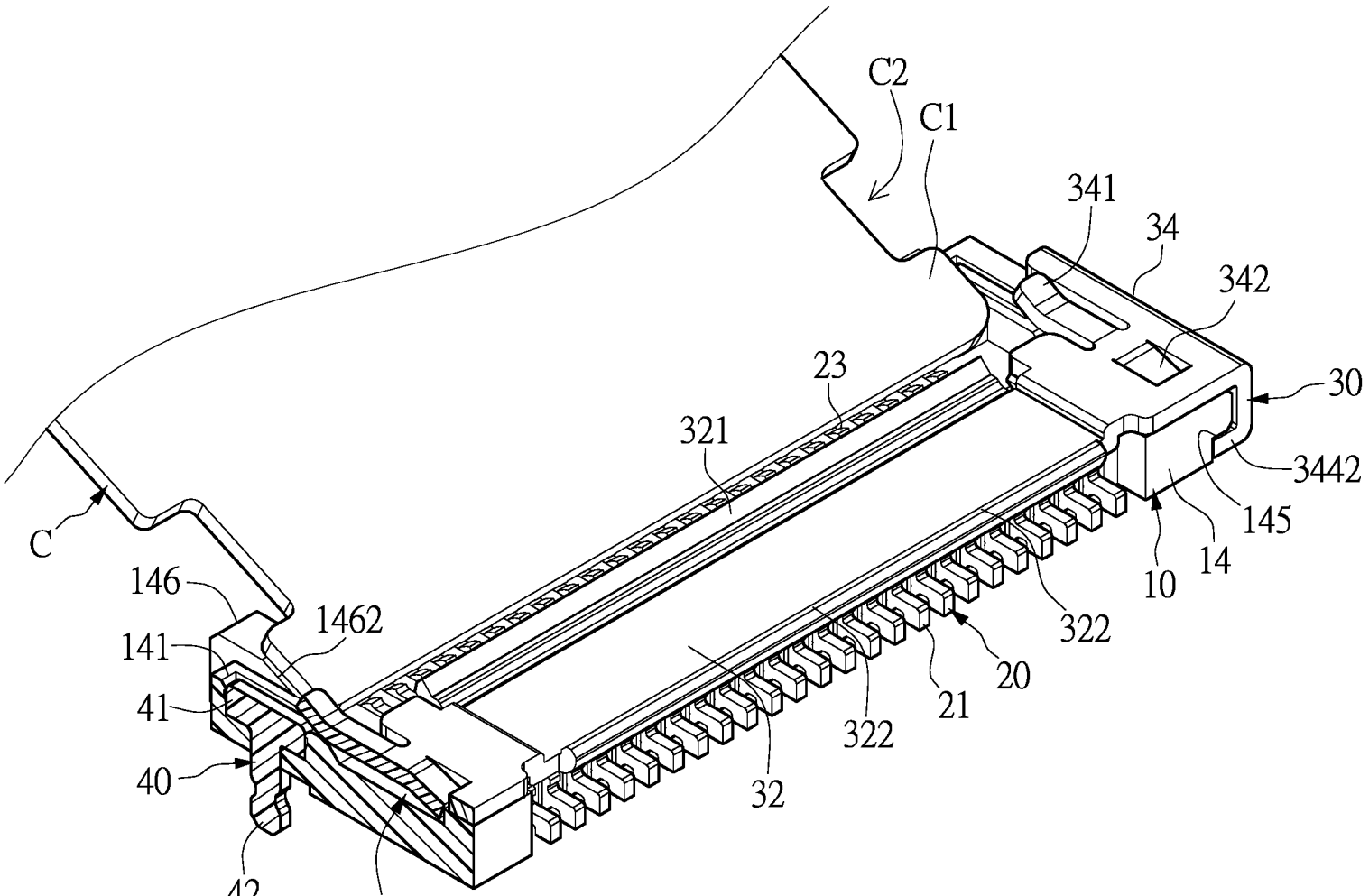
FIG. 4 is a perspective cross-sectional view of the electrical connector along a retaining pin in FIG. 3 according to the present disclosure.

Reference is made to FIG. 3, which is an assembled perspective view of the electrical connector for FFC/FPC according to the present disclosure. Details of this embodiment to lock the metal cover 30 at the initial position and the pressed position are described in detail as follows. The pair of shoulder parts 14 of the insulating housing 10 respectively has a rear blocking recess 142, a lower track groove 145, and a front stopper 148. The rear blocking recess 142 forms concavely on a top surface of the shoulder part 14. The front stopper 148 is located at a front end of one side of the shoulder part 14. The lower track groove 145 is located at a rear end of one side of the shoulder part 14. The front stopper 148 of this embodiment protrudes outwardly from one side of the shoulder part 14. The pair of side sliding rails 34 of the metal cover 30 respectively forms a rear stop tab 342 and a lower rail 3442. The rear stop tab 342 extends downward from a part of the top wall of the side sliding rail 34. In this embodiment, the rear stop tab 342 is formed by punching a portion of the top wall of the side sliding rail 34. As shown in FIG. 4, a portion of the bottom end of the side sliding rail 34 is bent to form the lower rail 3442, which is substantially parallel to the top wall of the side sliding rail 34, and slidably disposed on the lower track groove 145. The rear blocking recess 142 of the insulating housing 10 can block the rear stop tab 342 of the metal cover 30, so that the metal cover 30 is stopped at the initial position, and is able to prevent the metal cover 30 from moving rearward. The front stopper 148 blocks the lower rail 3442, so that the metal cover 30 is stopped at the pressed position, and is able to prevent the metal cover 30 from moving forward. In addition, a pair of pressing arms 341 respectively extends from the pair of side sliding rails 34, and the pressing arms 341 positionally correspond to the retaining pins 40.

Steps of assembling the FFC/FPC C to the electrical connector 1 according to the present disclosure are introduced as follows. An initial step of guiding the FFC/FPC C is as shown in FIG. 4. Two fixing portions C1 at two sides of a front end of the FFC/FPC C move downward along the guiding ramp 1462 of the guiding bump 146, and the FFC/FPC C is obliquely inserted into an upper portion of the main body 12 of the insulating housing 10.

Figure 5:
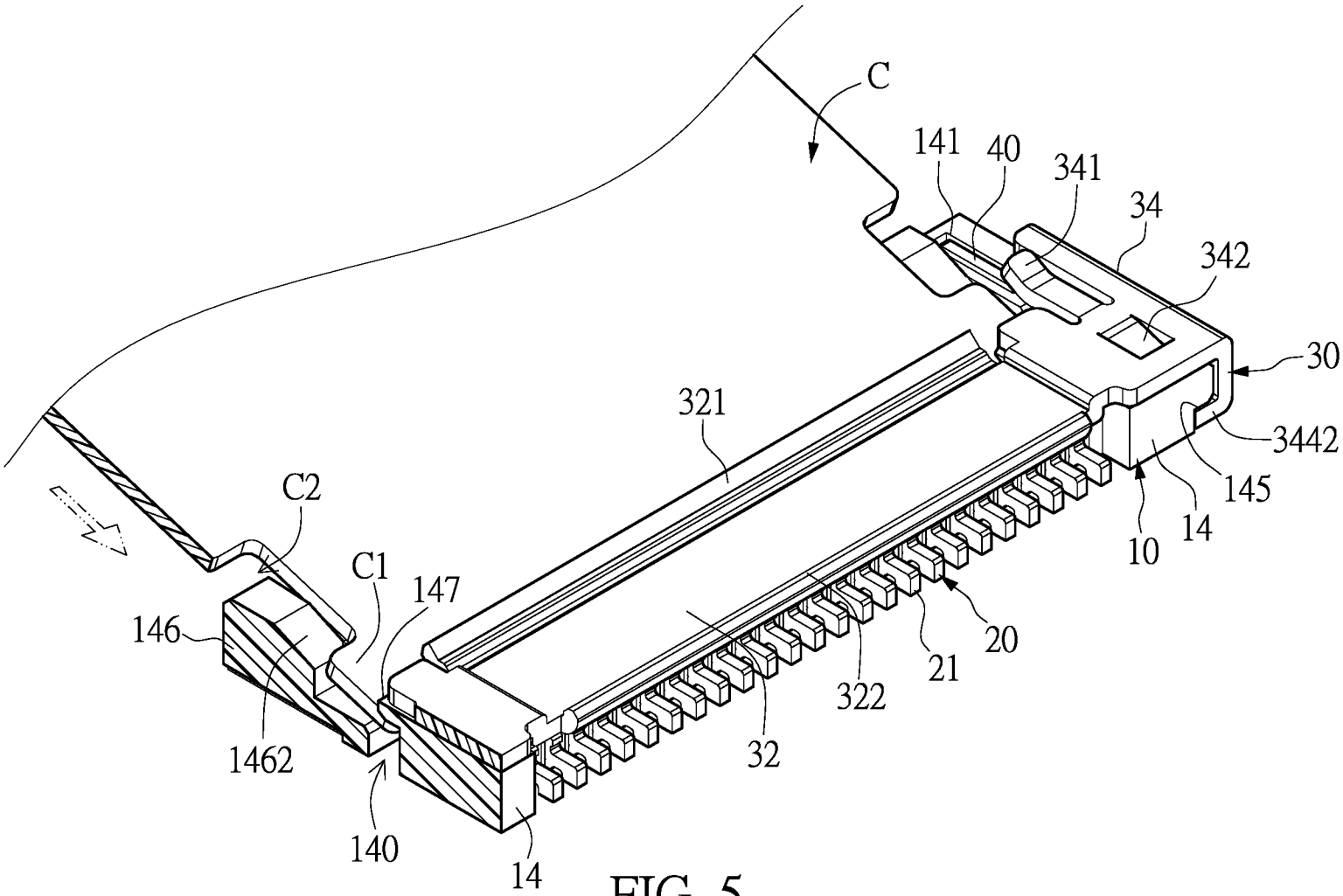
FIG. 5 is a perspective cross-sectional view of the electrical connector along a guiding bump in FIG. 3 of an initial guiding step according to the present disclosure.
Figure 6:
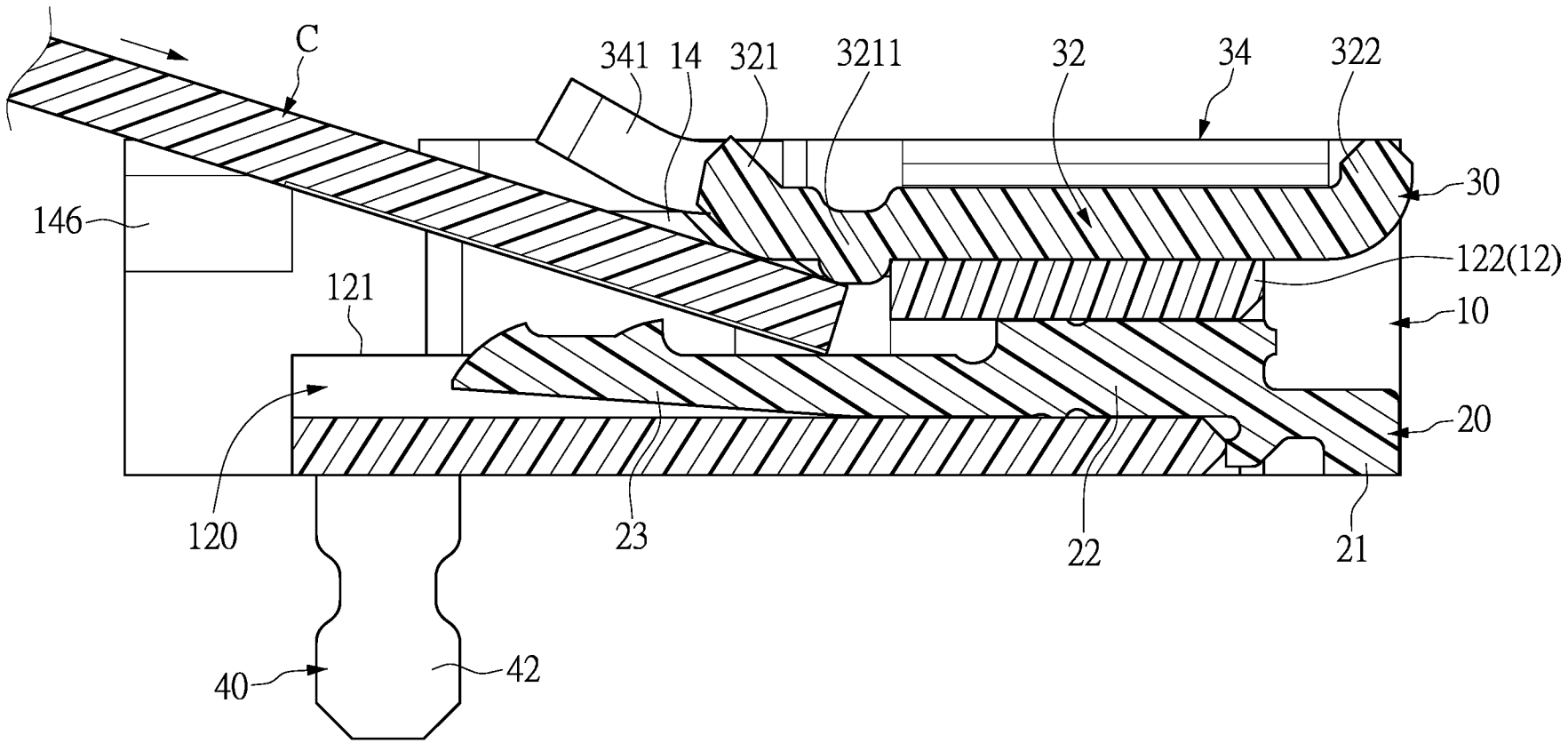
FIG. 6 is a cross-sectional view of the electrical connector along the VI-VI line in FIG. 3 of a second guiding step according to the present disclosure.

As shown in FIG. 5 and FIG. 6, a second step of guiding the FFC/FPC C is introduced as follows according to the present disclosure. The FFC/FPC C continuously moves downward along the guiding ramps 1462 of the guiding bump 146. A front edge of the FFC/FPC C is guided downward by the front guiding portion 321 of the metal cover 30 to enter the oblique-entry space 140, so that the two fixing portions C1 at two sides of the front end of the FFC/FPC C are brought into the oblique-entry space 140 of the shoulder part 14. As shown in FIG. 5 of this embodiment, the pre-pressing board 147 of the insulating housing 10 extends beyond a front edge of the rear portion 122, so as to contact and limit the front end of the fixing portion C1 of the FFC/FPC C.

Figure 7:
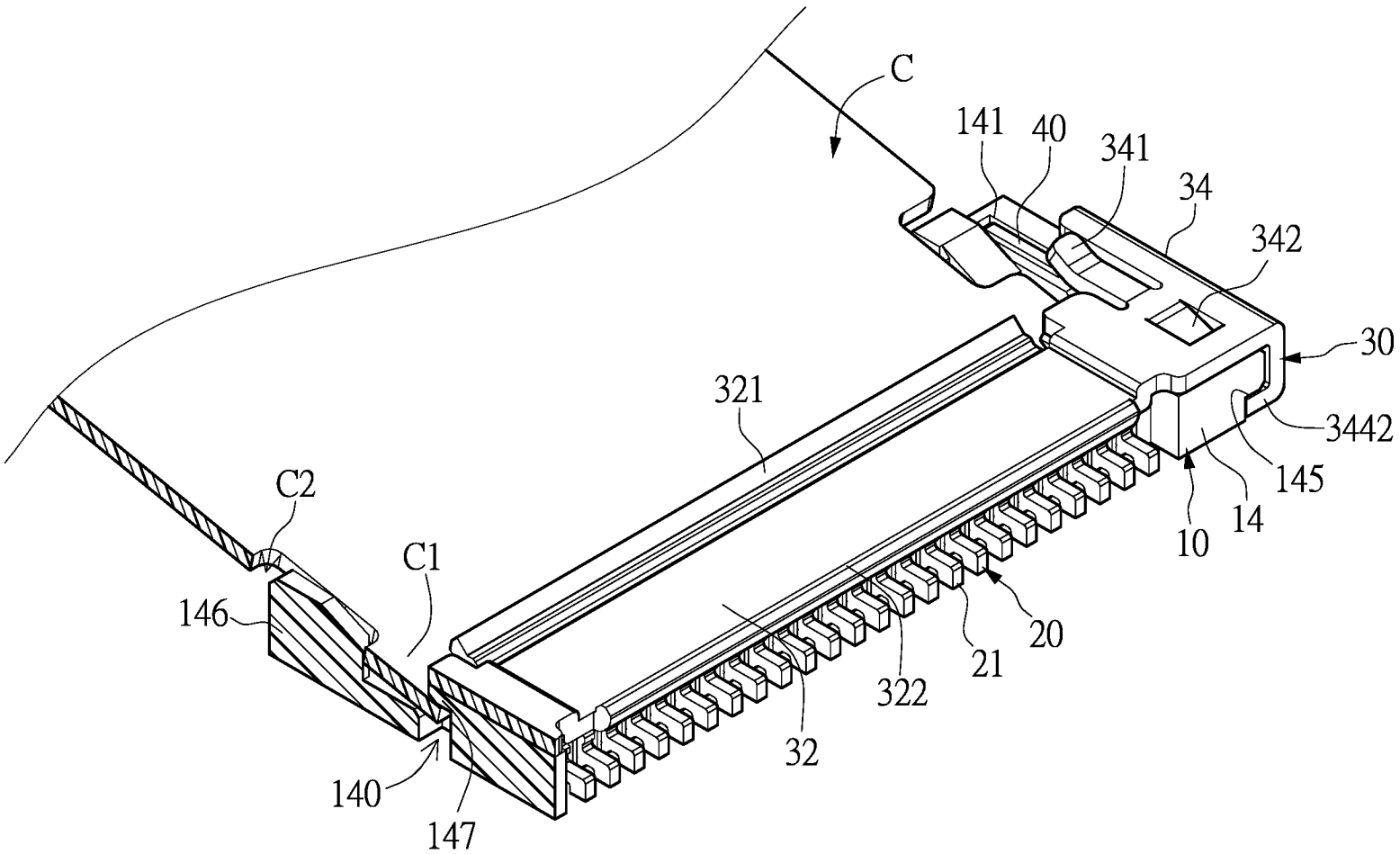
FIG. 7 is a perspective cross-sectional view of the electrical connector of the first embodiment in a pre-pressing step according to the first embodiment of the present disclosure.
Figure 8:
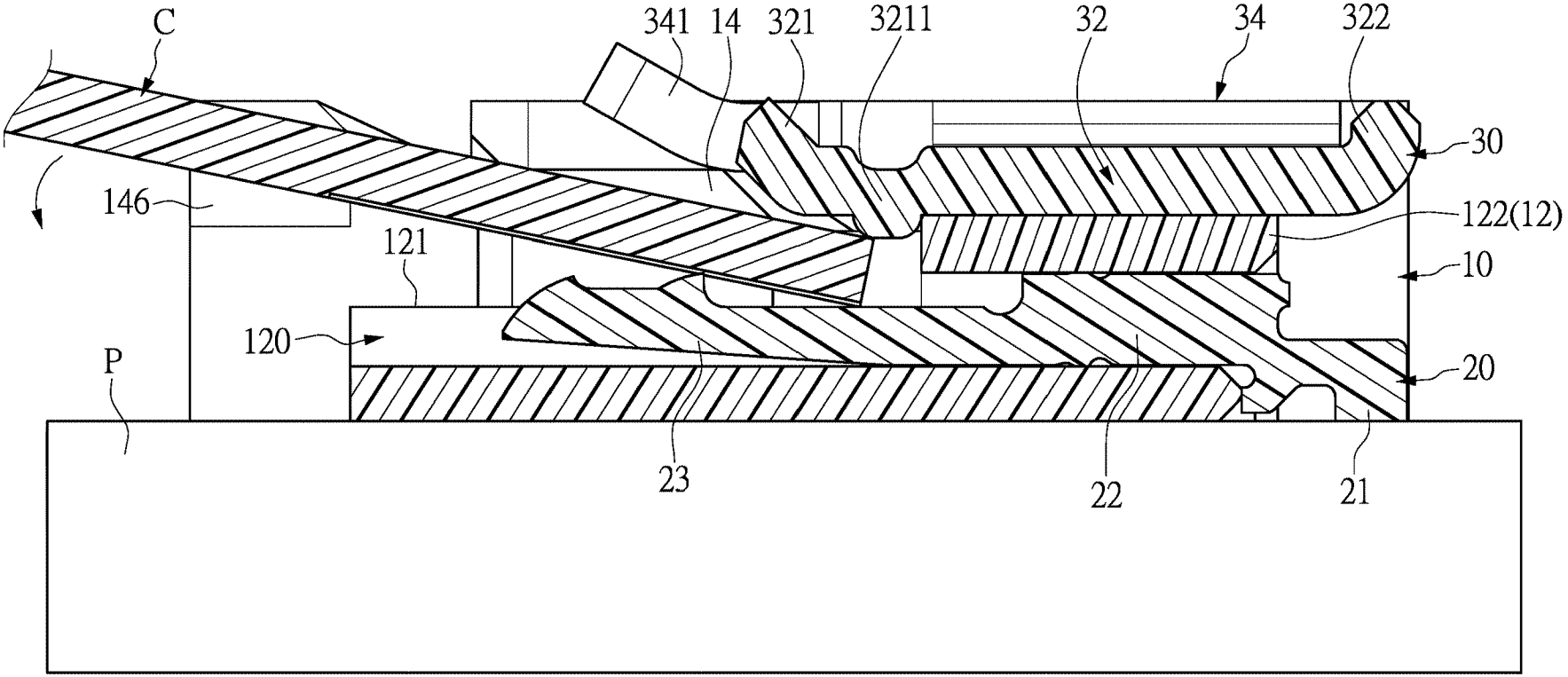
FIG. 8 is a cross-sectional view of the electrical connector of the first embodiment in the pre-pressing step according to the first embodiment of the present disclosure.

Reference is made to FIG. 7 and FIG. 8, which show pre-pressing steps of the present disclosure. When the fixing portion C1 of the FFC/FPC C fully enters the oblique-entry space 140, a cutout C2 of the FFC/FPC C is moved to an upper space of the guiding bump 146. Next, the FFC/FPC C rotates downward along an axle of its front edge, so that the cutout C2 of the FFC/FPC C is inserted in the guiding bump 146 of the insulating housing 10. Therefore, an occurrence of displacement of the FFC/FPC C is reduced. In this embodiment, a length of the oblique-entry space 140 along the longitudinal direction is substantially equal to or slightly larger than a length of the fixing portion C1 along the longitudinal direction, so as to accommodate the fixing portion C1 of the FFC/FPC C. Two sides of the FFC/FPC C further have two cutouts C2, a length of the cutouts C2 along the longitudinal direction is substantially equal to or slightly larger than a length of the guiding bump 146 along the longitudinal direction. As shown in FIG. 8, the front edge of the FFC/FPC C contacts with the pressing rib 3211 of the top pressing plate 32 and the rear portion 122 of the main body 12. A bottom surface of the FFC/FPC C contacts the contacting portion 23 of the conductive terminal 20.

Figure 10:
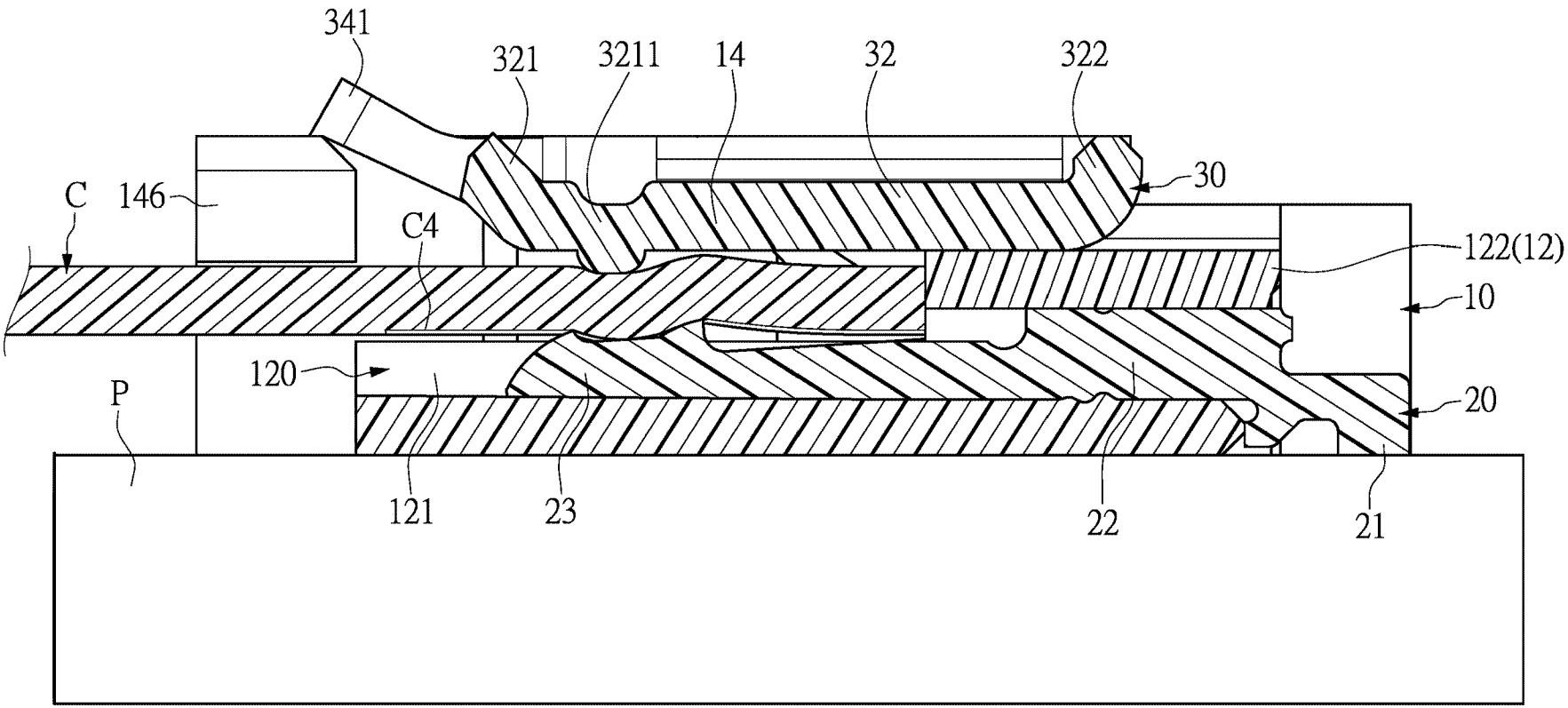
FIG. 10 is a cross-sectional view of the electrical connector along an X-X line in FIG. 9 according to the present disclosure.

Reference is made to FIG. 9 and FIG. 10. An inner side of the guiding bump 146 further has an upper stopper 1464. When the FFC/FPC C is pressed downward and disposed horizontally, the upper stopper 1464 contacts the top surface of the FFC/FPC C, and the FFC/FPC C can be prevented from being detached. The top end of the upper stopper 1464 also forms an oblique surface, which helps the FFC/FPC C for being guided to move downward. Afterward, the metal cover 30 is pushed forward, and the pressing rib 3211 of the metal cover 30 is forwardly moved to a position above the front portion 121 of the insulating housing 10, and pressing the top surface of the FFC/FPC C simultaneously. The pressing rib 3211 is substantially disposed above the contacting portion 23 of the conductive terminal 20, so that the conductor C4 on the bottom surface of the FFC/FPC C can surely contact the contacting portion 23 of the conductive terminal 20. The positioning knob 3443 of the side sliding rail 34 is moved from a rear area to a front area of the stop protrusion 143 of the shoulder part 14.

In summary, when the FFC/FPC C is inserted into the electrical connector 1 of the present disclosure, the fixing portion C1 of the FFC/FPC C is blocked in the oblique-entry space 140 by the guiding bump 146, and the pre-pressing board 147 presses the front end of the FFC/FPC C. When the metal cover 30 is moved to the pressed position, the metal cover 30 contacts the pair of retaining pins 40, and the pressing rib 3211 of the metal cover 30 presses against the FFC/FPC C so as to electrically connect the conductive terminals 20. With the metal cover 30, the electrical connector 1 for FFC/FPC can reduce an overall height thereof. In addition, the guiding bump 146 and the oblique-entry space 140 of the insulating housing 10 reduces the occurrence of displacement of the FFC/FPC C, and cooperates with the sliding manner of the metal cover 30, so that the FFC/FPC can be stably fixed and an occurrence of displacement of the FFC/FPC can be reduced.

Second Embodiment

Figure 11:
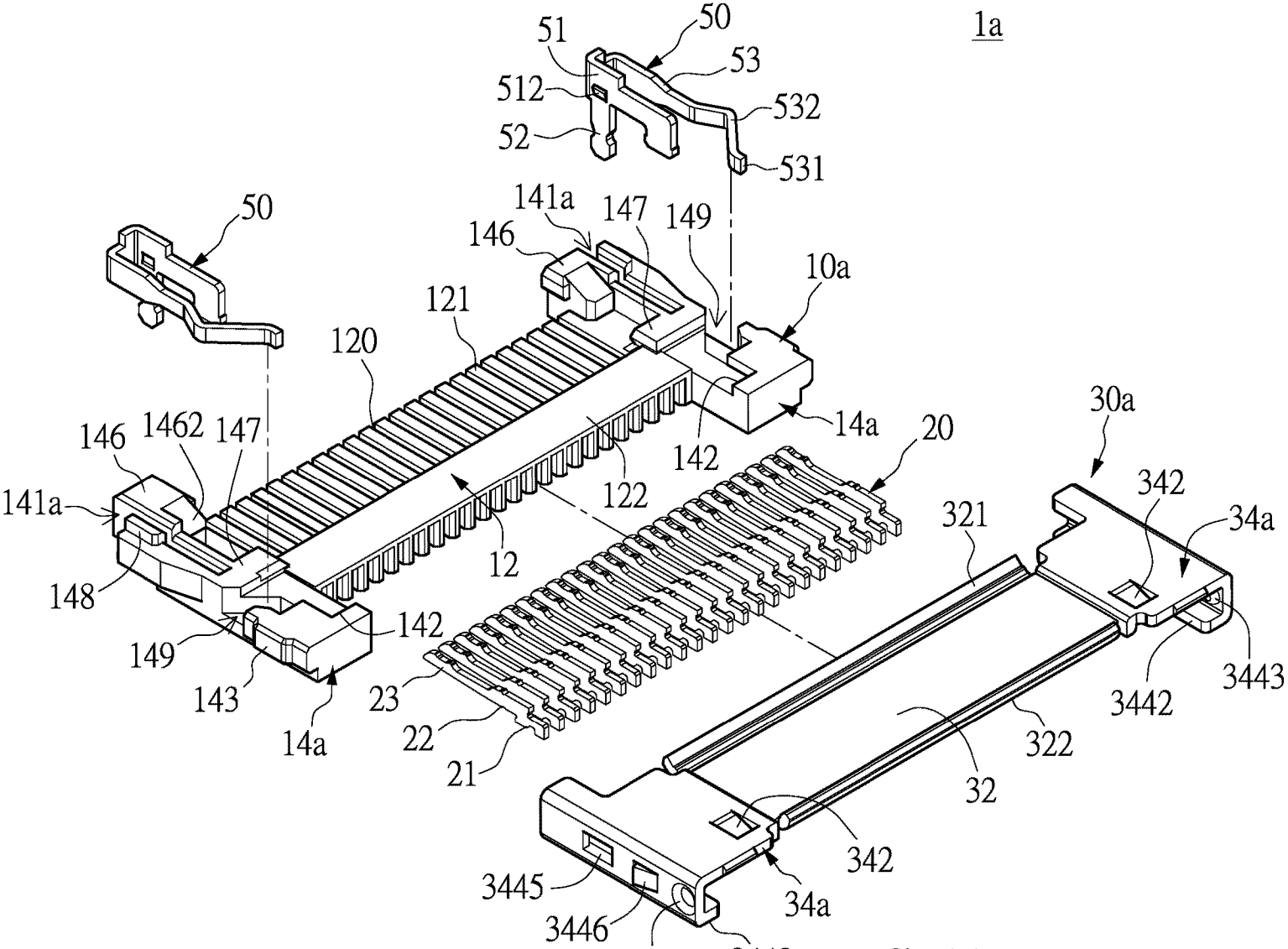
FIG. 11 is a perspective exploded view of the electrical connector for FFC/FPC of a second embodiment according to the present disclosure.
Figure 12:
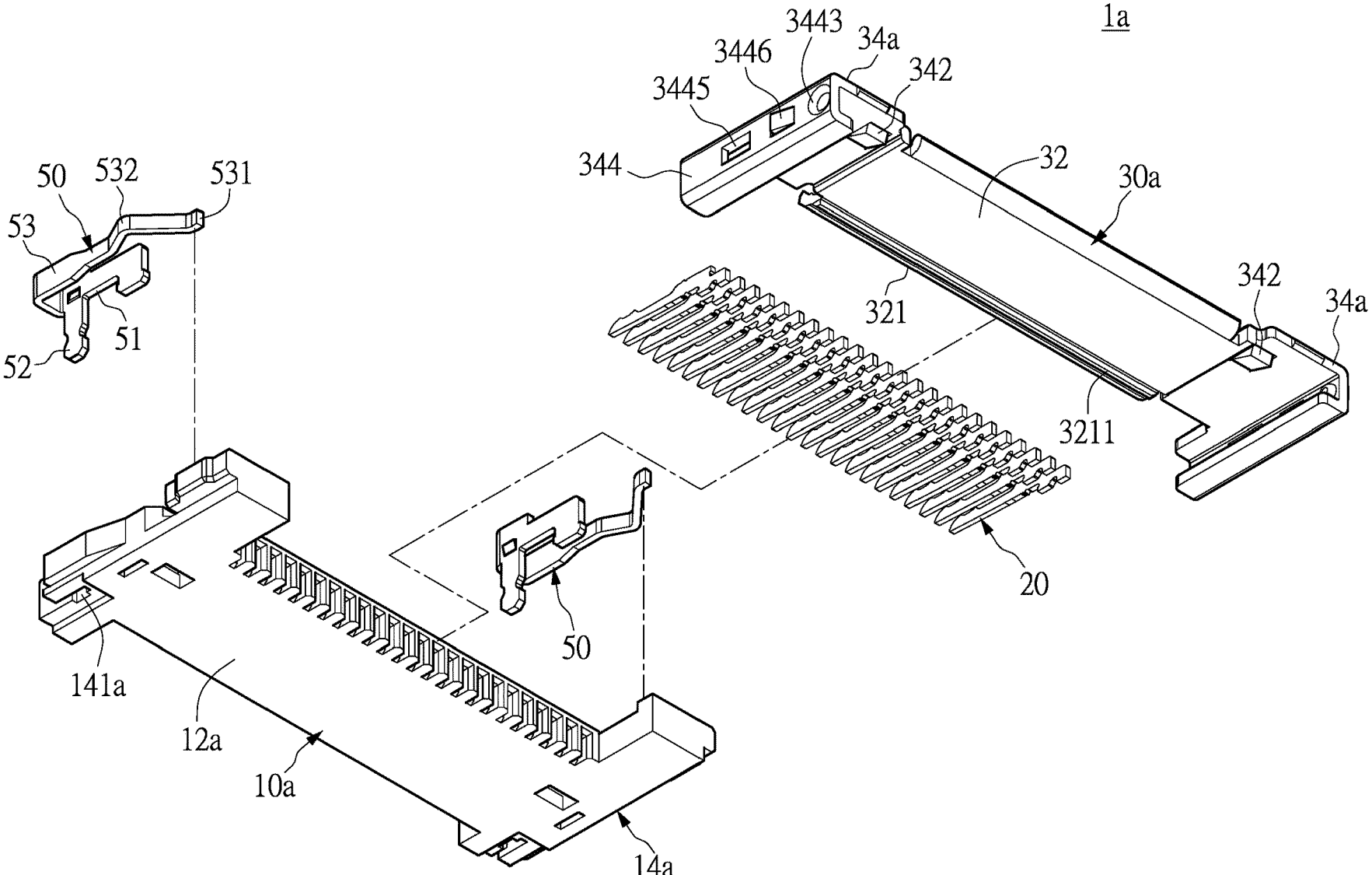
FIG. 12 is another perspective exploded view of the electrical connector of the second embodiment according to the present disclosure.

Reference is made to FIG. 11 and FIG. 12, which are perspective exploded views of the electrical connector for FFC/FPC of the second embodiment according to the present disclosure. In this embodiment, the main difference between the electrical connector 1*a* for FFC/FPC and the first embodiment is that the retaining pins are different. A retaining pin 50 of the second embodiment has a top arm 51, a soldering portion 52 and a lateral retaining arm 53. The soldering portion 52 extends downward from the top arm 51. The lateral retaining arm 53 extends from a front end of the top arm 51, and is bent to one side of the top arm 51. The lateral retaining arm 53 includes a blocking portion 532 protruded outward therefrom. A free end 531 of the lateral retaining arm 53 is fixed to a shoulder part 14*a* of an insulating housing 10*a*.

Figure 13:
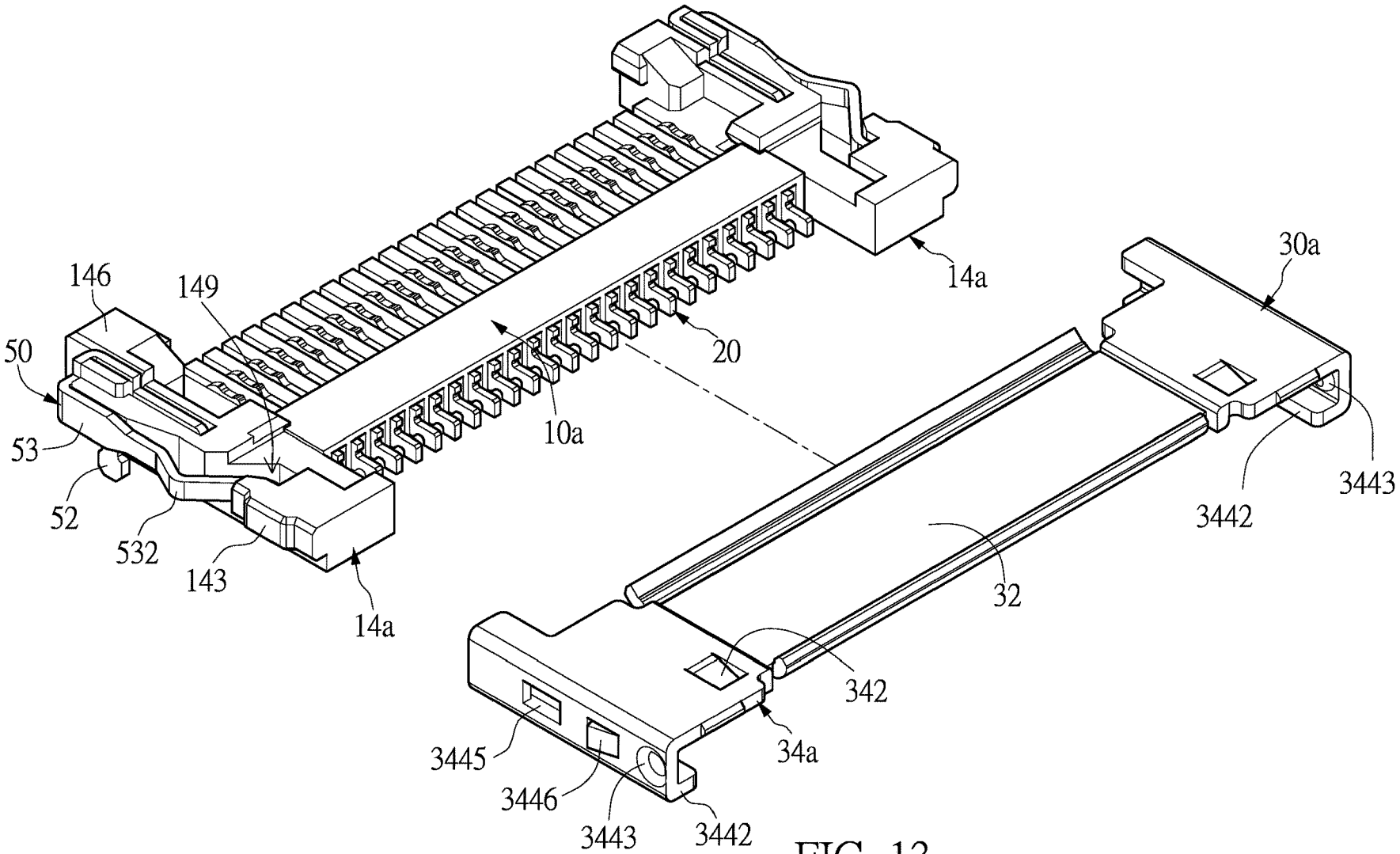
FIG. 13 is a perspective partially-exploded view of the electrical connector of the second embodiment according to the present disclosure.

To match with the retaining pin 50, the shoulder part 14*a* of the insulating housing 10*a* has a different structure. The pair of shoulder parts 14*a* respectively has a lateral-insertion slit 141*a* connected to a front end thereof, so as to receive the top arm 51 of the retaining pin 50. The top arm 51 has an interfering portion 512 so as to be fixed in the lateral-insertion slit 141*a*. This embodiment further includes a front stopper 148. The front stopper 148 protrudes from the top surface of the shoulder part 14*a*, so as to block the metal cover 30*a*. The lateral-insertion slit 141*a* is arranged at an outer side of the guiding bump 146, and passes through the front stopper 148. The shoulder part 14*a* has a side retaining slot 149 formed on one side thereof, so as to receive the free end 531 of the retaining pin 50. As shown in FIG. 13, the electrical connector 1*a* for FFC/FPC is assembled.

Figure 14:
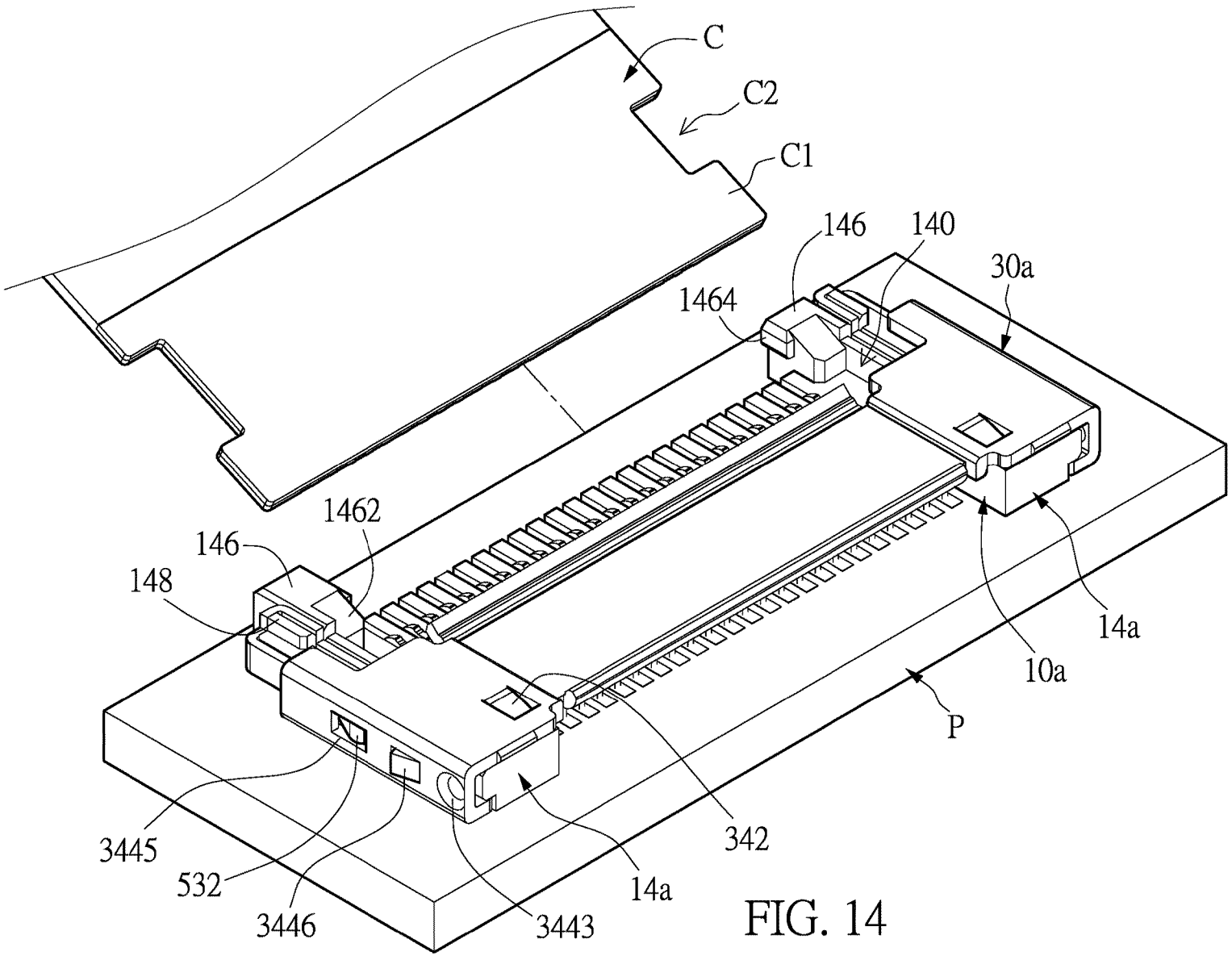
FIG. 14 is a perspective assembled view of the electrical connector of the second embodiment according to the present disclosure.
Figure 18:
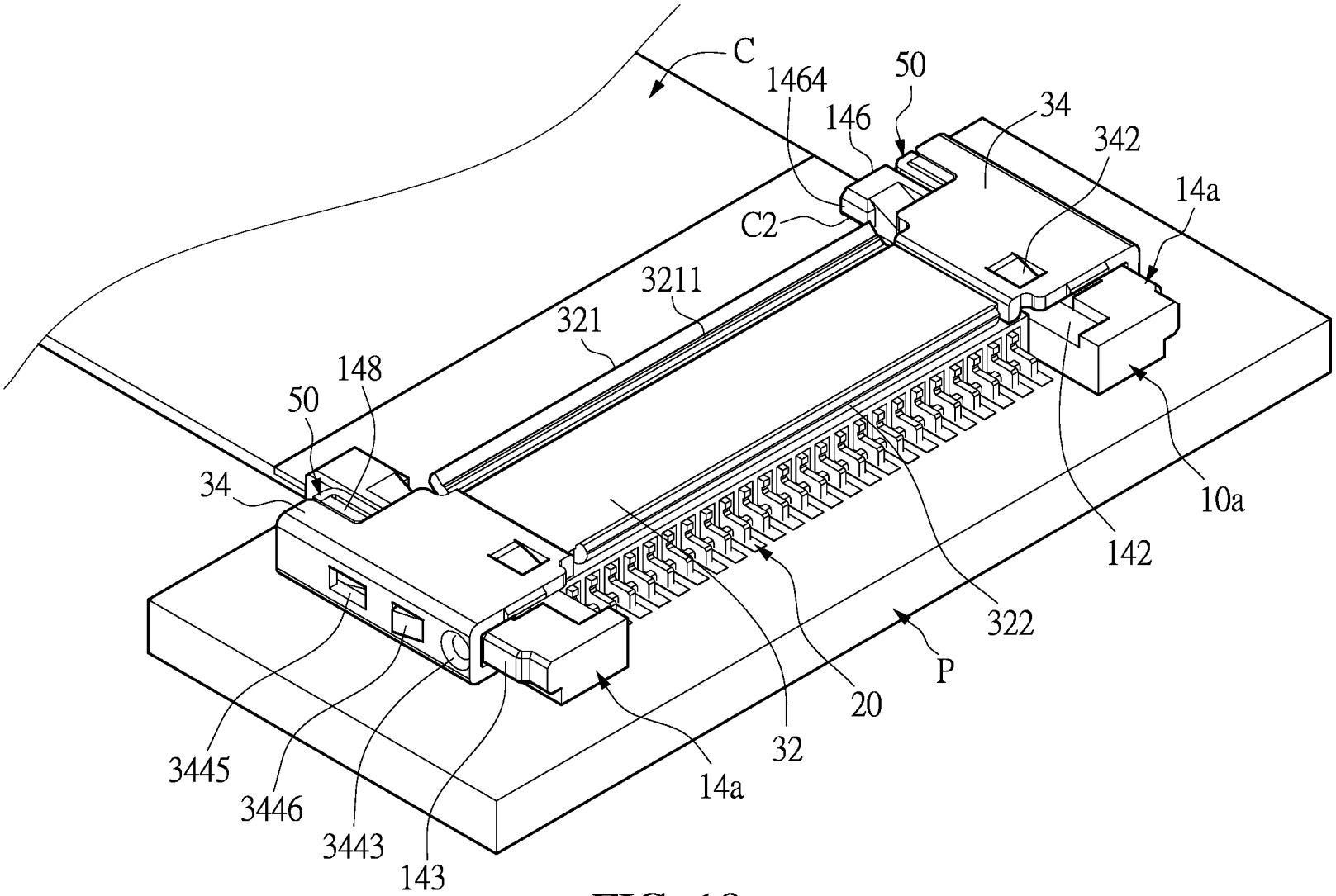
FIG. 18 is a perspective view of the electrical connector of the second embodiment with the metal cover moved to a pressed position according to the present disclosure.

Each side wall of the pair of side sliding rails 34*a* of the metal cover 30*a* includes a front positioning opening 3445, and a rear positioning recess 3446. The lateral retaining arm 53 is movable between the front positioning opening 3445 and the rear positioning recess 3446 of the side sliding rail 34*a*, so that the lateral retaining arm 53 can continuously contact the side sliding rail 34*a* of the metal cover 30*a* stably to form a shielding environment that is completely stable. In addition, the rear positioning recess 3446 of this embodiment is formed by punching the side sliding rail 34*a* outward to form a semi-circular opening, so that a gap is formed. The lateral retaining arm 53 thus can be rebounded with some voice or slight vibration, and the user can know that the metal cover 30*a* has been moved to a predetermined position during operation. In addition, because the rear positioning recess 3446 is a half opening, the lateral retaining arm 53 still contacts the metal cover 30*a* stably. When the blocking portion 532 of the lateral retaining arm 53 is engaged into the front positioning opening 3445, the metal cover 30*a* is stopped at the initial position (as shown in FIG. 14). When the blocking portion 532 of the lateral retaining arm 53 is engaged into the rear positioning recess 3446, the metal cover 30*a* is stopped at the pressed position (as shown in FIG. 18).

Figure 15:
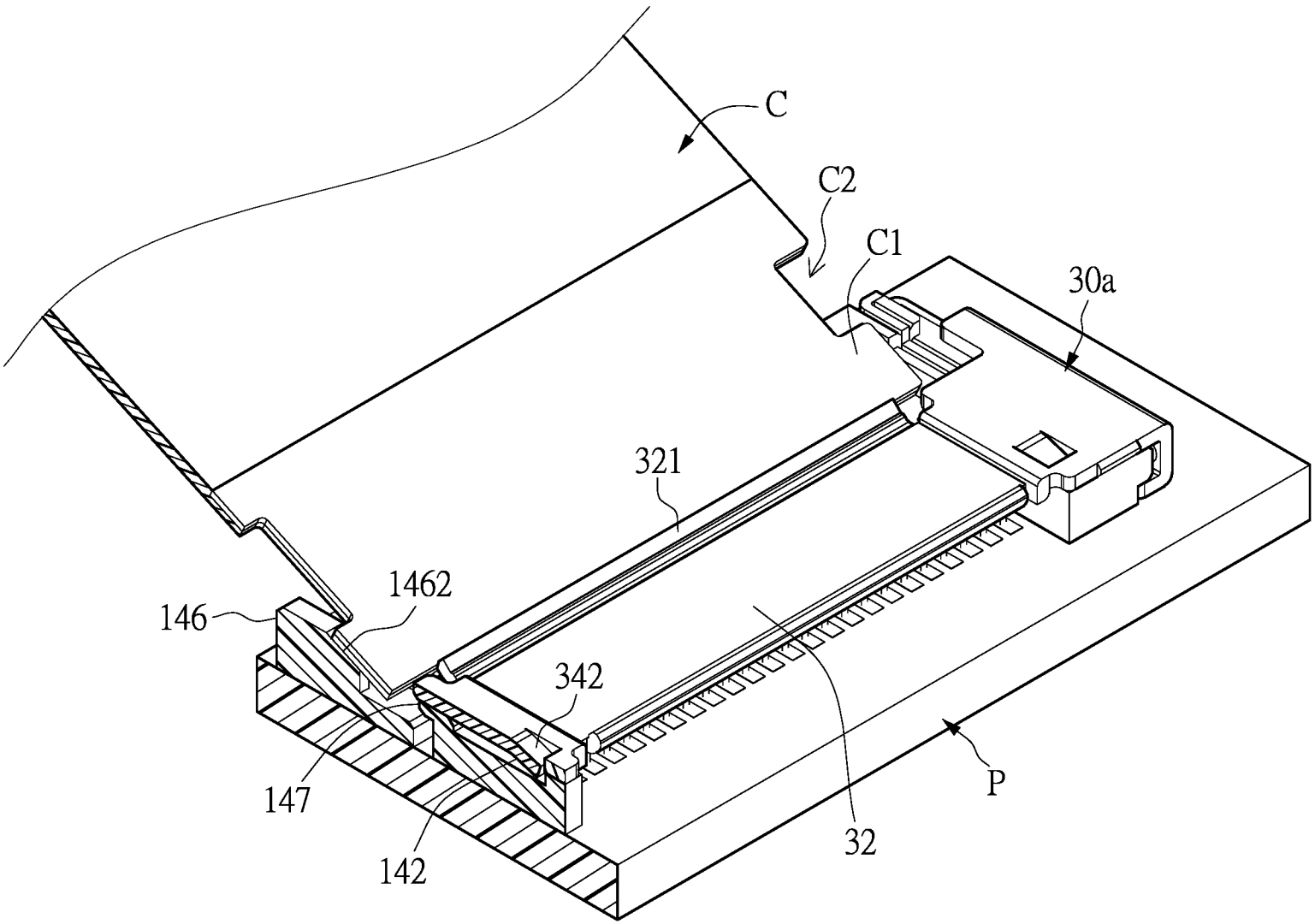
FIG. 15 is a perspective view of the electrical connector of the second embodiment in an initial guiding step according to the present disclosure.

Reference is made to FIG. 14 and FIG. 15. Assembling steps of this embodiment of inserting the FFC/FPC C in the electrical connector 1*a* are the same as the first embodiment. In an initial step, the FFC/FPC C firstly is inserted in the insulating housing 10*a* along the guiding ramp 1462 of the guiding bump 146.

Figure 16:
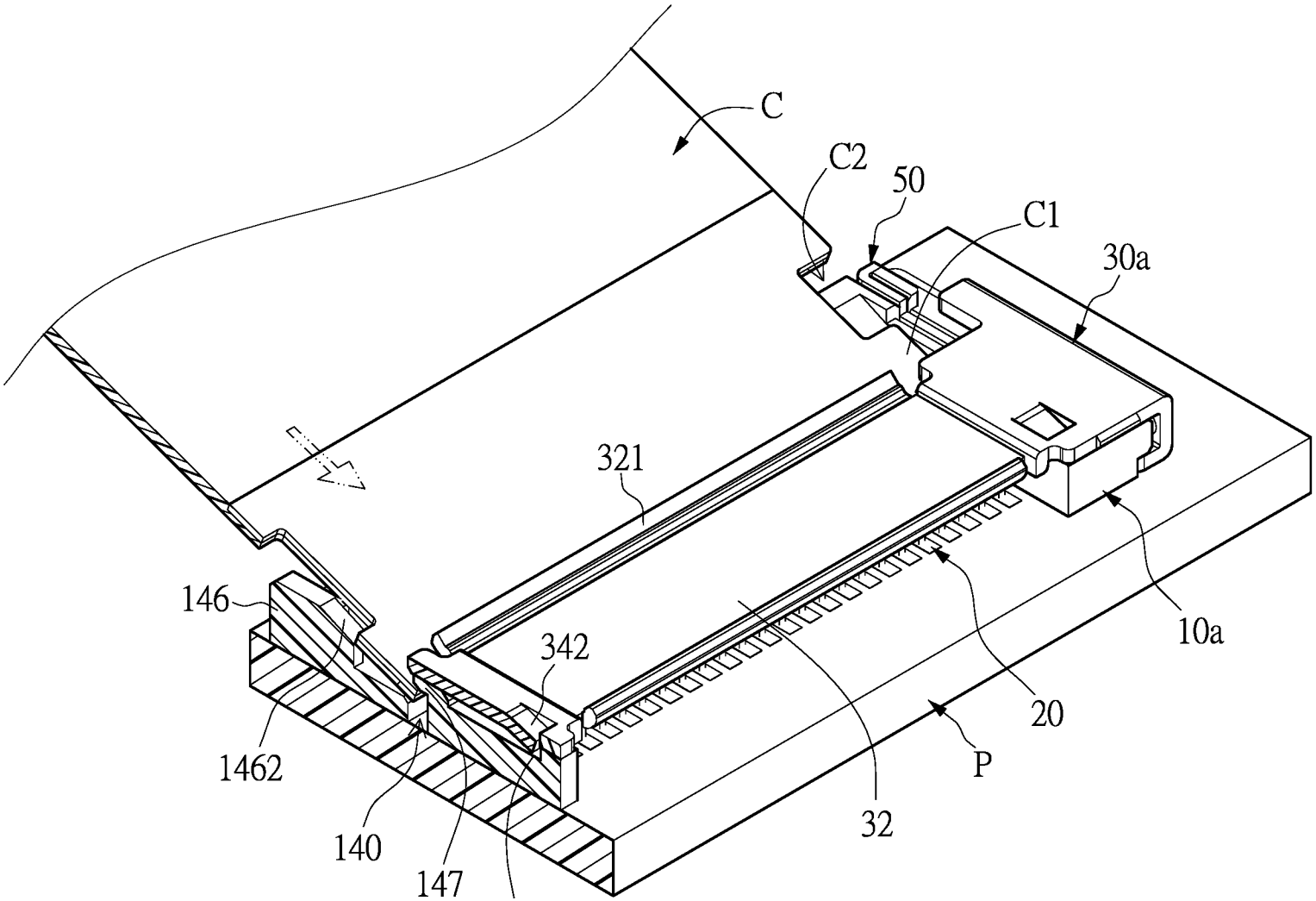
FIG. 16 is a perspective cross-sectional view of the electrical connector of the second embodiment in a second guiding step according to the present disclosure.

Reference is made to FIG. 16, which is a perspective view of the FFC/FPC in a second guiding step of the present disclosure. The front edge of the FFC/FPC C is inserted underneath the pre-pressing board 147. FIG. 5 and FIG. 6 can be referred to for a position of the FFC/FPC C, the pre-pressing board 147 contacts and limits the front end of the fixing portion C1 of the FFC/FPC C.

Figure 17:
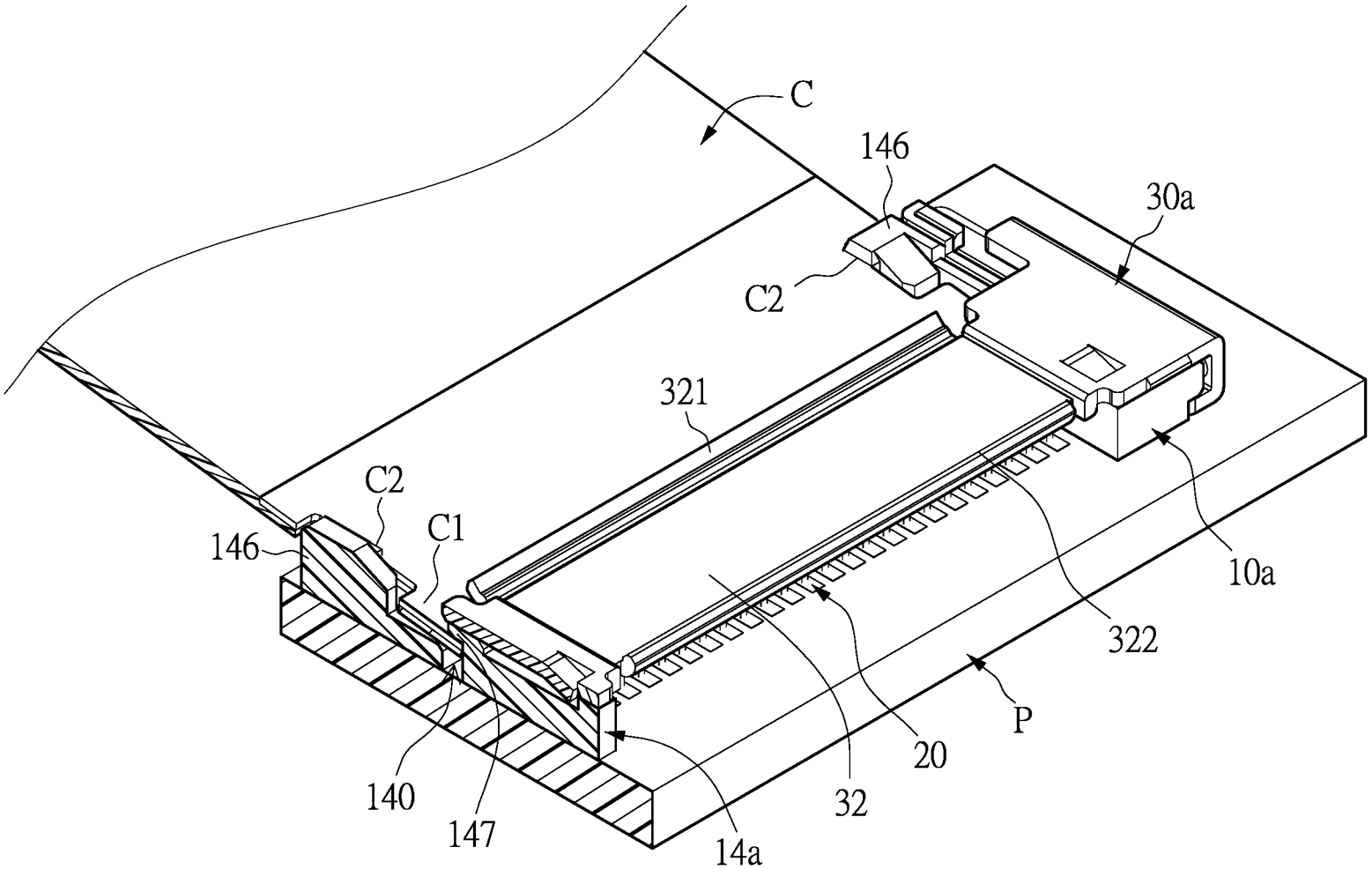
FIG. 17 is a perspective cross-sectional view of the electrical connector of the second embodiment in a pre-pressing step according to the present disclosure.

Reference is made to FIG. 17, which is a perspective view of the FFC/FPC in a pre-pressing step of the present disclosure. The FFC/FPC C is downwardly pressed along its front edge as an axis, so that the guiding bump 146 is inserted into the cutout C2. FIG. 7 and FIG. 8 can be referred to for the position of the FFC/FPC C. The front edge of the FFC/FPC C contacts the pressing rib 3211 of the top pressing plate 32, and is close to the rear portion 122 of the main body 12*a*. The bottom surface of the FFC/FPC C contacts the contacting portions 23 of the conductive terminal 20.

Finally, as shown in FIG. 18, the metal cover 30*a* is slid and stopped at the pressed position, and the FFC/FPC C is pressed and contacted with the conductive terminals 20. FIG. 10 can be referred to for the position of the FFC/FPC C.

Beneficial effects of the present disclosure are as follows. The electrical connector (1, 1*a*) for FFC/FPC has the metal cover (30, 30*a*) which is moved in a horizontal sliding manner, so that the overall height can be reduced. In addition, the guiding bump 146 and the oblique-entry space 140 of the insulating housing 10*a* can reduce an occurrence of displacement of the FFC/FPC C, and cooperate with a horizontal sliding manner of the metal cover 30, 30*a* to press down the FFC/FPC C, so that the FFC/FPC C can be stably fixed and an occurrence of displacement of the FFC/FPC can be reduced. Furthermore, the metal cover covers the FFC/FPC, which can shield electromagnetic interference.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector for receiving a flexible flat cable (FFC)/flat printed circuit board (FPC), two sides of the FFC/FPC each having a fixing portion respectively, the electrical connector comprising:

an insulating housing including a main body and a pair of shoulder parts, the pair of shoulder parts respectively forming at two sides of the main body, the main body having a plurality of terminal slots, the pair of shoulder parts respectively having a guiding bump and a pre-pressing board, and an oblique-entry space being formed between the guiding bump and the pre-pressing board;

a plurality of conductive terminals being respectively received in the terminal slots;

a pair of retaining pins being respectively fixed in the pair of shoulder parts, an end of each of the retaining pins being exposed from a bottom of the insulating housing; and a metal cover being slidably disposed on a top surface of the insulating housing, the metal cover including a top pressing plate and a pair of side sliding rails, the pair of side sliding rails respectively connected to two sides of the top pressing plate, the pair of side sliding rails being slidably mounted on the pair of shoulder parts respectively, a front end of the top pressing plate having a pressing rib, the pressing rib protruding toward the insulating housing, and the metal cover being movable between an initial position and a pressed position;

wherein when the FFC/FPC is inserted in the electrical connector for FFC/FPC, the fixing portion of the FFC/FPC is received in the oblique-entry space, and the pre-pressing board presses against a top surface of the FFC/FPC; when the metal cover is moved to the pressed position, the metal cover contacts with the pair of retaining pins, and the pressing rib of the metal cover presses the FFC/FPC to contact with the conductive terminals.

2. The electrical connector according to claim 1, wherein a pair of lateral-insertion slits are respectively formed on the pair of shoulder parts, the pair of lateral-insertion slits are formed at an outer side of the guiding bumps, the pair of retaining pins are respectively received in the pair of lateral-insertion slits, each of the retaining pins includes a top portion and a leg portion, the leg portion is exposed from the bottom of the insulating housing so as to be soldered to a printed circuit board, and the top portion is exposed from a top surface of the insulating housing.

3. The electrical connector according to claim 1, wherein the main body of the insulating housing includes a front portion and a rear portion, the terminal slots pass through a top surface of the front portion, the conductive terminals include a plurality of contacting portions exposed from the top surface of the front portion, a height of the rear portion is higher than a height of the front portion, and the pre-pressing board extends beyond a front edge of the rear portion.

4. The electrical connector according to claim 1, wherein the guiding bumps each has a guiding ramp, the pre-pressing board is protruded toward the guiding ramp, and the guiding bump further includes an upper stopper at an inner side thereof.

5. The electrical connector according to claim 1, wherein the pair of shoulder parts of the insulating housing respectively includes a rear blocking recess and a front stopper, the rear blocking recess is formed concavely on the top surface of the shoulder part, the front stopper is disposed at a front end of the shoulder part, the pair of side sliding rails of the metal cover respectively has a rear stop tab and a lower rail, the rear stop tab extends downward from a portion of a top wall of the side sliding rail, and a portion of a bottom end of the side sliding rail is bent to form a lower rail; wherein the rear blocking recess stops the rear stop tab, so that the metal cover is stopped at the initial position; wherein the front stopper stops the lower rail, and the metal cover is stopped at the pressed position.

6. The electrical connector according to claim 1, wherein the pair of shoulder parts of the insulating housing respectively has a stop protrusion formed at an outer side thereof, the pair of side sliding rails of the metal cover respectively has a positioning knob, the positioning knob protrudes toward the insulating housing, and the positioning knob is slidably located between a front end and a rear end of the stop protrusion correspondingly to the pressed position and the initial position of the metal cover.

7. The electrical connector according to claim 1, wherein the pair of side sliding rails of the metal cover respectively includes a pressing arm extending forward, and the pressing arm positionally corresponds to the retaining pin.

8. The electrical connector according to claim 1, wherein the metal cover includes a front guiding portion extending upward and obliquely from a front edge of the top pressing plate, and a holding portion extending upward from a rear edge of the top pressing plate.

9. The electrical connector according to claim 1, wherein the retaining pin includes a top arm, a soldering portion and a lateral retaining arm, the soldering portion extends downward from the top arm, the lateral retaining arm extends from a front end of the top arm and bends to one side of the top arm, the lateral retaining arm has a blocking portion protruding outward, and one end of the lateral retaining arm is fixed to the shoulder part.

10. The electrical connector according to claim 9, wherein the pair of shoulder parts respectively have a lateral-insertion slit formed thereon, the lateral-insertion slit is arranged at an outer side of the guiding bump, and the top arm is fixed in the lateral-insertion slit;

wherein each of the side sliding rails of the metal cover has a side wall including a front positioning opening and a rear positioning recess; wherein the blocking portion of the lateral retaining arm is engaged in the front positioning opening, so that the metal cover is stopped at the initial position, wherein the blocking portion of the lateral retaining arm is engaged in the rear positioning recess, so that the metal cover is stopped at the pressed position.

* * * * *